US008359737B2

(12) United States Patent
Englundh

(10) Patent No.: US 8,359,737 B2
(45) Date of Patent: Jan. 29, 2013

(54) DEVICE FOR CONNECTING A FRAMEWORK OF LENGTH OF TIMBER

(75) Inventor: Lars Englundh, Åsa (SE)

(73) Assignee: Nordiska Truss AB, Falkenberg (SE)

( * ) Notice: Subject to any disclaimer, the term of this patent is extended or adjusted under 35 U.S.C. 154(b) by 886 days.

(21) Appl. No.: 12/308,820

(22) PCT Filed: Jul. 3, 2007

(86) PCT No.: PCT/SE2007/000658

§ 371 (c)(1),
(2), (4) Date: Dec. 24, 2008

(87) PCT Pub. No.: WO2008/004950

PCT Pub. Date: Jan. 10, 2008

(65) Prior Publication Data

US 2009/0235613 A1 Sep. 24, 2009

(30) Foreign Application Priority Data

Jul. 6, 2006 (SE) ..... 0601495

(51) Int. Cl.
*B23P 19/00* (2006.01)
*B25C 7/00* (2006.01)
*B21D 47/00* (2006.01)

(52) U.S. Cl. ..... 29/798; 29/897.31; 29/809; 29/810; 29/464; 29/432; 100/913; 227/152; 227/113; 227/48

(58) Field of Classification Search ..... 29/798, 29/432, 897.31, 464, 809, 810; 100/913; 227/152, 48, 113
See application file for complete search history.

(56) References Cited

U.S. PATENT DOCUMENTS

| | | | | | |
|---|---|---|---|---|---|
| 3,100,301 | A | * | 8/1963 | Black | 227/152 |
| 3,172,125 | A | * | 3/1965 | Sanford | 227/99 |
| 3,255,943 | A | * | 6/1966 | Sanford | 227/152 |
| 3,358,348 | A | | 12/1967 | McGlinchey | |
| 3,358,589 | A | * | 12/1967 | Hentzschel | 100/100 |
| 3,390,627 | A | * | 7/1968 | Levkovitz | 100/41 |
| 3,390,628 | A | * | 7/1968 | Sanford | 100/100 |
| 3,667,375 | A | * | 6/1972 | Pottinger et al. | 99/408 |
| 3,728,958 | A | * | 4/1973 | Moehlenpah et al. | 100/100 |
| 3,769,771 | A | * | 11/1973 | Shannon et al. | 52/634 |
| 3,826,188 | A | | 7/1974 | Eberle | |
| 3,855,917 | A | * | 12/1974 | Farrell et al. | 100/35 |
| 3,896,717 | A | * | 7/1975 | Schmitt | 100/100 |
| 3,908,885 | A | * | 9/1975 | Scott | 227/152 |
| 3,915,444 | A | * | 10/1975 | Moehlenpah | 269/17 |

(Continued)

FOREIGN PATENT DOCUMENTS

| | | | | |
|---|---|---|---|---|
| AU | 9225392 | A | * | 4/1994 |
| EP | 1820609 | A2 | * | 8/2007 |

*Primary Examiner* — Essama Omgba
(74) *Attorney, Agent, or Firm* — McGinn IP Law Group PLLC

(57) ABSTRACT

A device for connecting a framework of lengths of timber includes a number of upper and lower frame sections, as well as a number of diagonals or struts wherein at least one press tool is disposed to fixedly press at least one nail plate over joints between the lengths of timber, and that the press tools are disposed in a portal with a number of upper beams and a number of lower beams on which the press tools are adjustable reciprocally across the framework between a position in which the press tool collects a pair of nail plates, and a position over a joint for fixedly pressing one of the nail plates on the upper side and the other on the under side of the joint.

12 Claims, 7 Drawing Sheets

U.S. PATENT DOCUMENTS 3,978,783 A * 9/1976 Moehlenpah ..... 100/353
3,985,278 A * 10/1976 Jureit et al. ..... 227/86
4,024,809 A * 5/1977 Moehlenpah ..... 100/100
4,089,107 A * 5/1978 Sanford ..... 29/798
4,154,164 A * 5/1979 Hammond ..... 100/153
4,241,681 A * 12/1980 Porter ..... 112/322
4,339,117 A * 7/1982 Tison ..... 269/289 MR
4,356,948 A * 11/1982 Bardenstein ..... 227/48
4,379,426 A * 4/1983 Thompson et al. ..... 100/100
4,669,184 A 6/1987 Castillo
5,048,409 A 9/1991 Schulz
5,211,108 A * 5/1993 Gore et al. ..... 100/48
5,211,381 A * 5/1993 Shaw ..... 269/37
5,285,720 A 2/1994 Wright
5,361,495 A * 11/1994 Pyle et al. ..... 29/897.31
5,553,375 A * 9/1996 Powers ..... 29/798
5,646,859 A * 7/1997 Petta et al. ..... 700/95
5,854,747 A * 12/1998 Fairlie ..... 700/114
5,873,567 A * 2/1999 Williams ..... 269/37
5,933,957 A * 8/1999 Haase ..... 29/897.31
6,170,163 B1 * 1/2001 Bordignon et al. ..... 33/16
6,219,904 B1 * 4/2001 Debanne ..... 29/701
6,318,251 B1 * 11/2001 Schulz ..... 100/48
6,702,269 B1 * 3/2004 Tadich ..... 269/37
6,823,577 B2 * 11/2004 Doyon et al. ..... 29/525.01
7,140,100 B2 * 11/2006 Kanjee et al. ..... 29/798
7,341,246 B2 * 3/2008 Donohue ..... 269/37
2003/0196326 A1 * 10/2003 McAdoo ..... 29/897.31
2004/0211049 A1 * 10/2004 Doyon et al. ..... 29/432
2005/0011375 A1 * 1/2005 Donohue ..... 100/913
2005/0071977 A1 * 4/2005 Kanjee et al. ..... 29/432
2005/0263560 A1 * 12/2005 Niblett et al. ..... 227/135
2010/0154218 A1 * 6/2010 Turulin ..... 29/897.31

* cited by examiner

DEVICE FOR CONNECTING A FRAMEWORK OF LENGTH OF TIMBER

BACKGROUND OF THE INVENTION

1. Field of the Invention

The present invention relates to a device for connecting a length of timber.

2. Description of the Related Art

Within the industry for the production of timber houses, e.g. prefabricated houses, and houses constructed from both timber and other materials, it is of major importance to be able to assemble frameworks, e.g. roof trusses, in as rapid and rational a manner as possible without jeopardising accuracy and reliability. It is further of importance that the positioning of the lengths of timber which have been pre-cut and otherwise pre-treated and which are included in the framework can be carried out rapidly and simply without any major risk of incorrect positioning. The lengths of timber put out in position are provisionally fixed to one another by means, for example, of fasteners with the aid of a fastener gun or the like in order to make possible movement of the framework for the final securing of the lengths of timber to one another at each joint by means of so-called nail plate joints that can be adapted to the different joints between the lengths of timber. There is thus a major need in the art for a device for rational handling of the nail plates and pressing into position of the correct nail plate across the joints intended therefore.

SUMMARY OF THE INVENTION

The task forming the basis of the present invention is to satisfy the above-outlined needs and wishes.

This task is solved according to the device of the present invention. In accordance with an exemplary aspect of the invention, a device for connecting a framework of lengths of timer, which include a number of upper framework sections, a number of lower framework sections, and a number of diagonals, includes at least one press tool disposed to fixedly press at least one nail plate over joints between lengths of timber, the press tools being disposed in a portal with a number of upper beams and a number of lower beams on which the press tools are adjustable reciprocally across the framework between a position in which the press tools collect a pair of nail plates and a position over a joint fixedly pressing one of the nail plates on an upper side and another on an under side of the joint.

The present invention realises a device or an installation for the rational and particularly rapid and effective construction of such frameworks as roof trusses and the like. In particular, the handling of the nail plates is greatly facilitated for assembling the different lengths of timber in that they are easy to lay in the correct position without the risk of error. The present invention further considerably facilitates the logistics surrounding the device, and in particular the handling of the nail plates for placing them out on the contemplated framework. This particularly applies to the selection of the correct nail plate for its intended joint in a rapid and reliable manner.

BRIEF DESCRIPTION OF THE DRAWINGS

The present invention will be described in greater detail hereinbelow, with reference to the accompanying Drawings.

DETAILED DESCRIPTION OF EXEMPLARY EMBODIMENTS OF THE INVENTION

Figure 1:
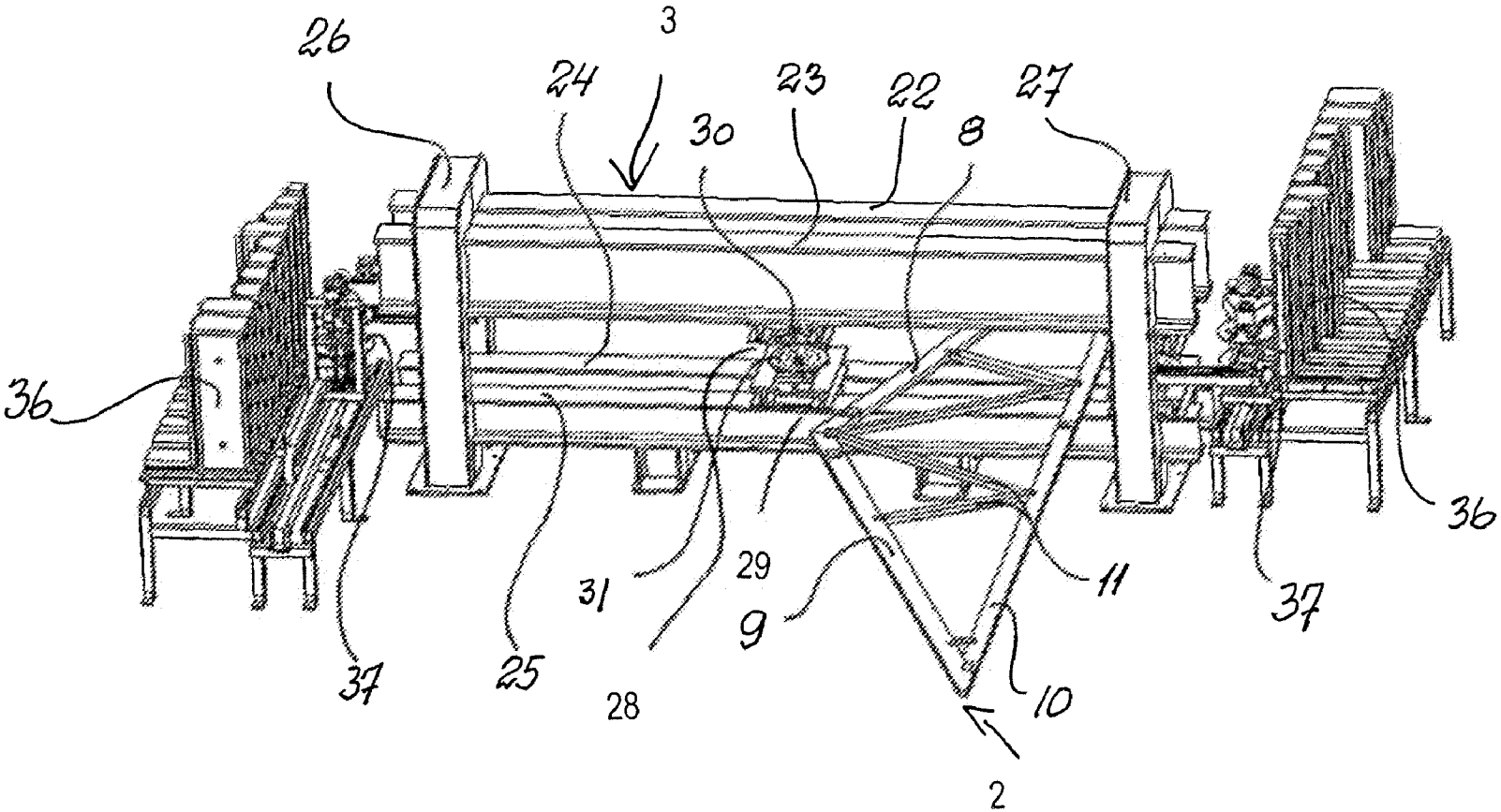
FIG. 1 is a view of a part of one embodiment of a device according to the present invention.

A device according to one embodiment of the present invention will be described in greater detail hereinbelow in connection with the assembly of roof trusses. FIG. 1 shows a roof truss 2 which is on its way through a portal 3, a part of the roof truss 2 being located on an infeed table and a part of the roof truss 2 which has passed through the portal 3 being located on a discharge table. In other words, the roof truss 2 is provisionally assembled from lengths of timber and consists of two upper frame sections 8 and 9, and a lower frame section 10, as well as braces or struts, or diagonals 11.

Figure 4:
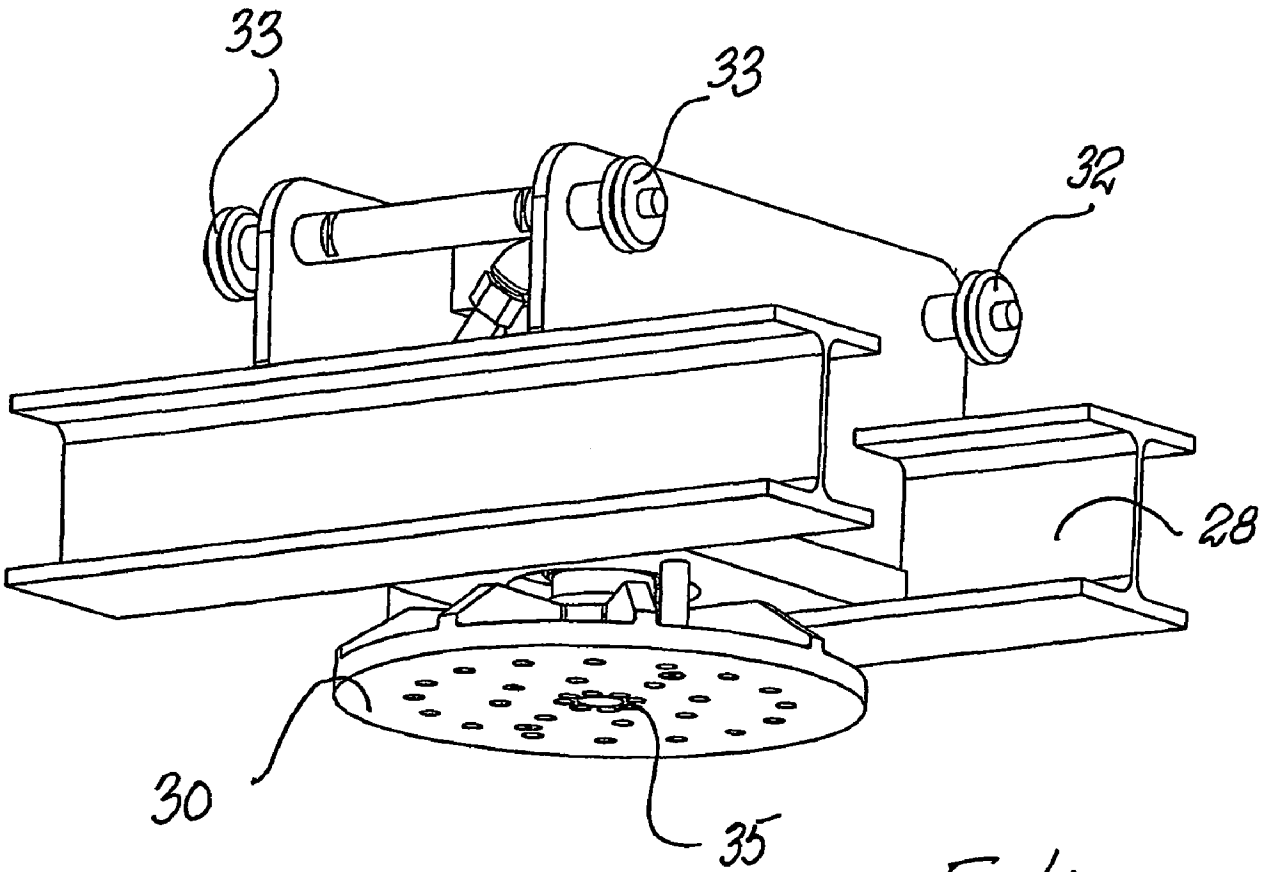
FIG. 4 is a perspective view from beneath of a part of the device according to FIGS. 1 and 2.

The portal 3 includes a number of upper beams 22, 23 and a number of lower beams 24, 25 which are interconnected to one another with the aid of end walls 26 and 27. In the portal 3, there is provided a press tool comprising an upper carriage 28 and a lower carriage 29. The carriages 28 and 29 each support a press plate 30 and 31, as well as a number of runner wheels 32 and 33 for moving the carriages 28, 29 along the beams 22, 23, 24 and 25. The end walls 26, 27 are centrally open so as to permit access to the carriages 28, 29 and the press plates 30, 31. FIG. 4 shows a press tool carriage 28 with a press plate 30. The runner wheels 33 of the carriage 28 are clearly apparent in FIG. 4. The press tool carriages 28 and 29 each support a piston and cylinder assembly 34 for switching the press plates 30 and 31 towards one another and thereby to and away from the joints in the framework 2. The press plates 30 and 31 each support a magnet or magnets 35 each for fixedly retaining a nail plate 38 during transport of the nail plate from a collection position at the end wall 26, 27 and to the desired joint where the plates 38 are to be fixedly pressed over the joint.

Figure 2:
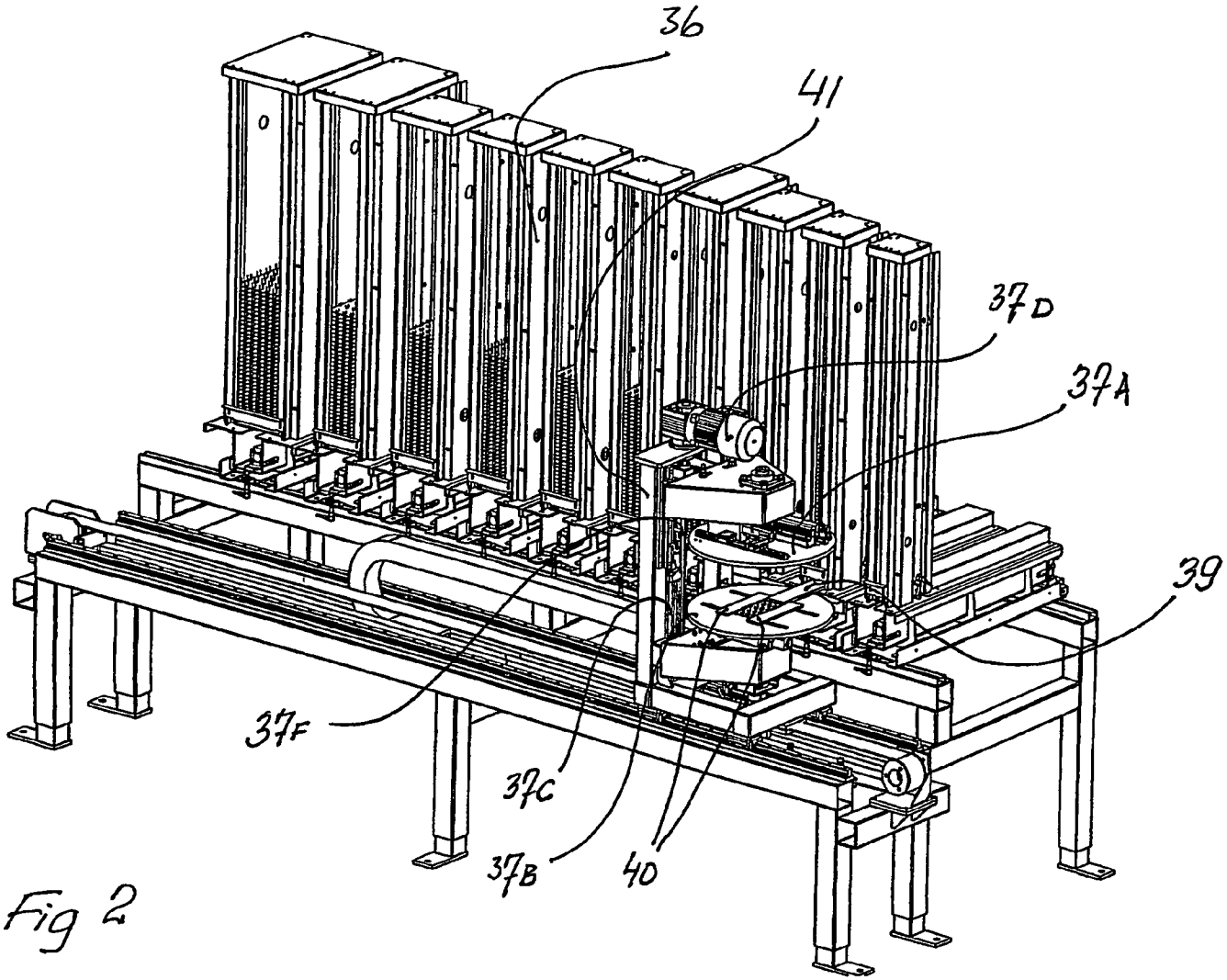
FIG. 2 is a view of a number of magazine-, and collection and orientation devices for the device according to the present invention.
Figure 3:
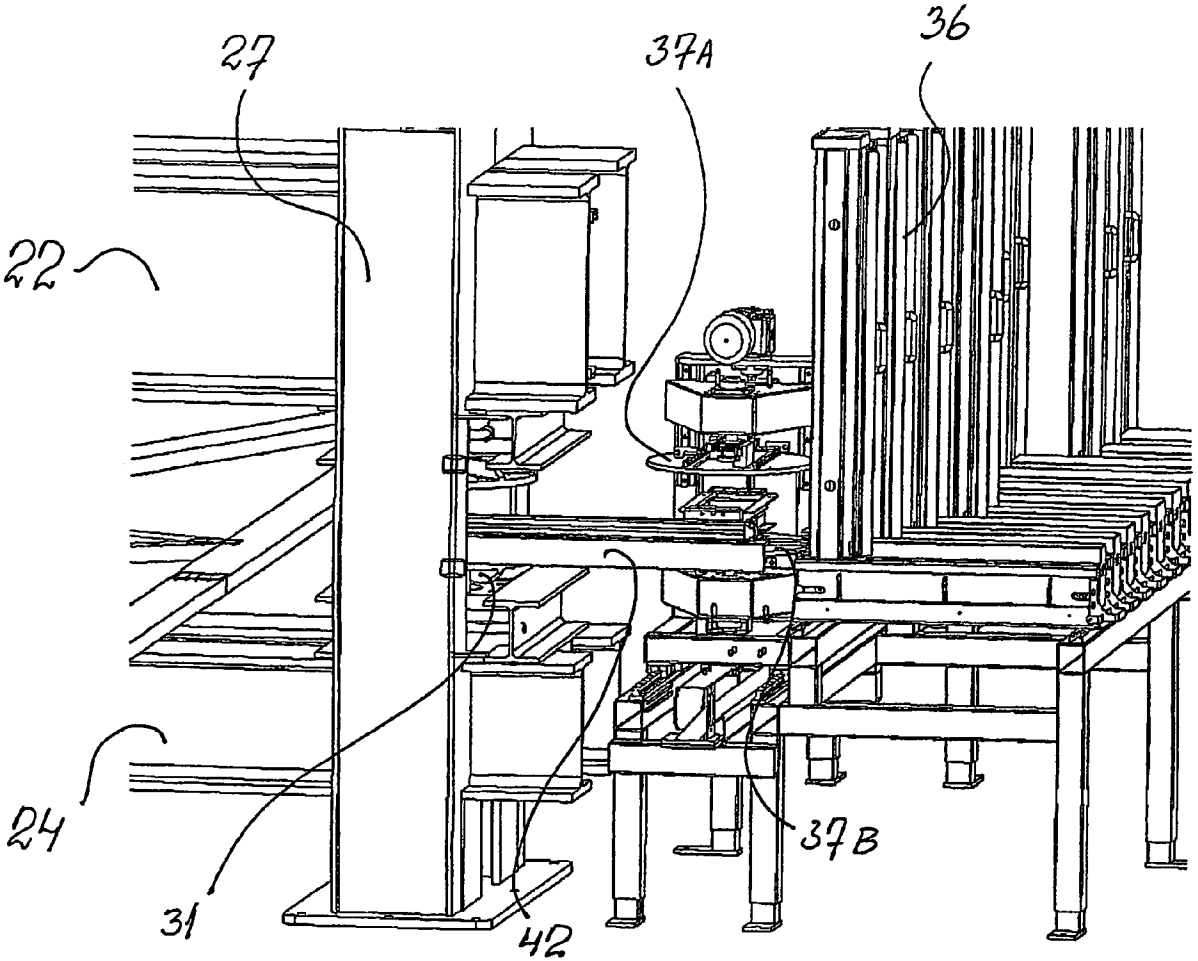
FIG. 3 is a view of parts of the device according to one embodiment of the present invention located at a collection position.
Figure 5:
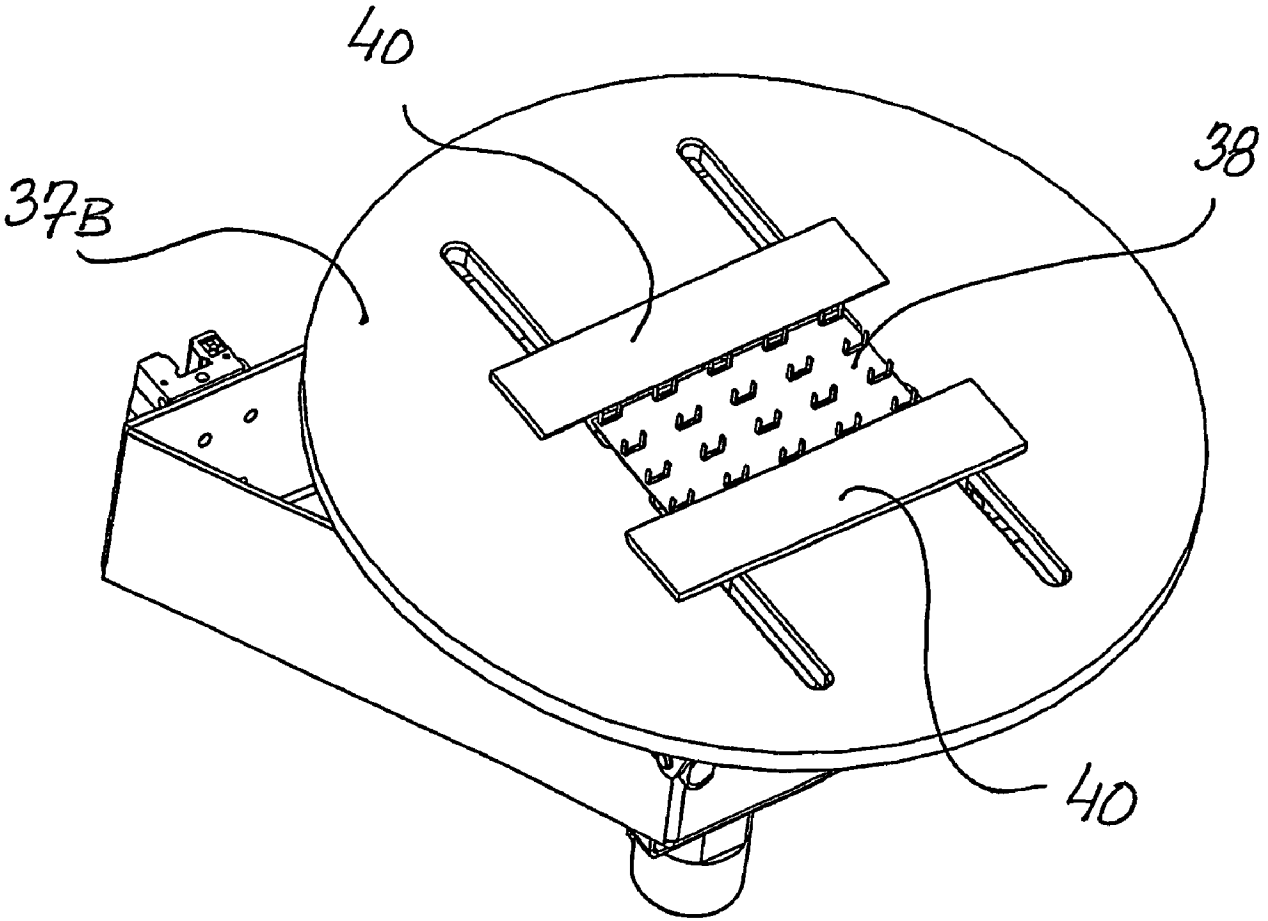
FIG. 5 is a view of a part of the orientation devices for the device according to the present invention.
Figure 6:
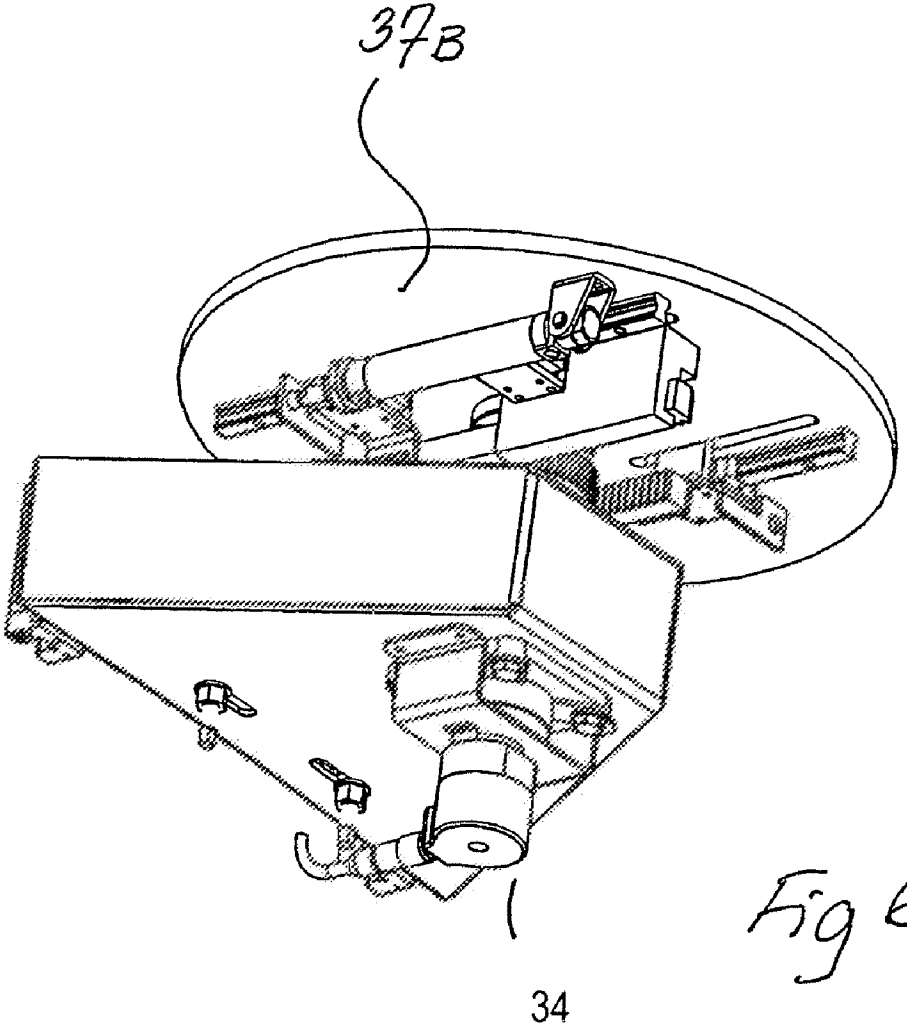
FIG. 6 is a view from beneath of the parts illustrated in FIG. 5.
Figure 7:
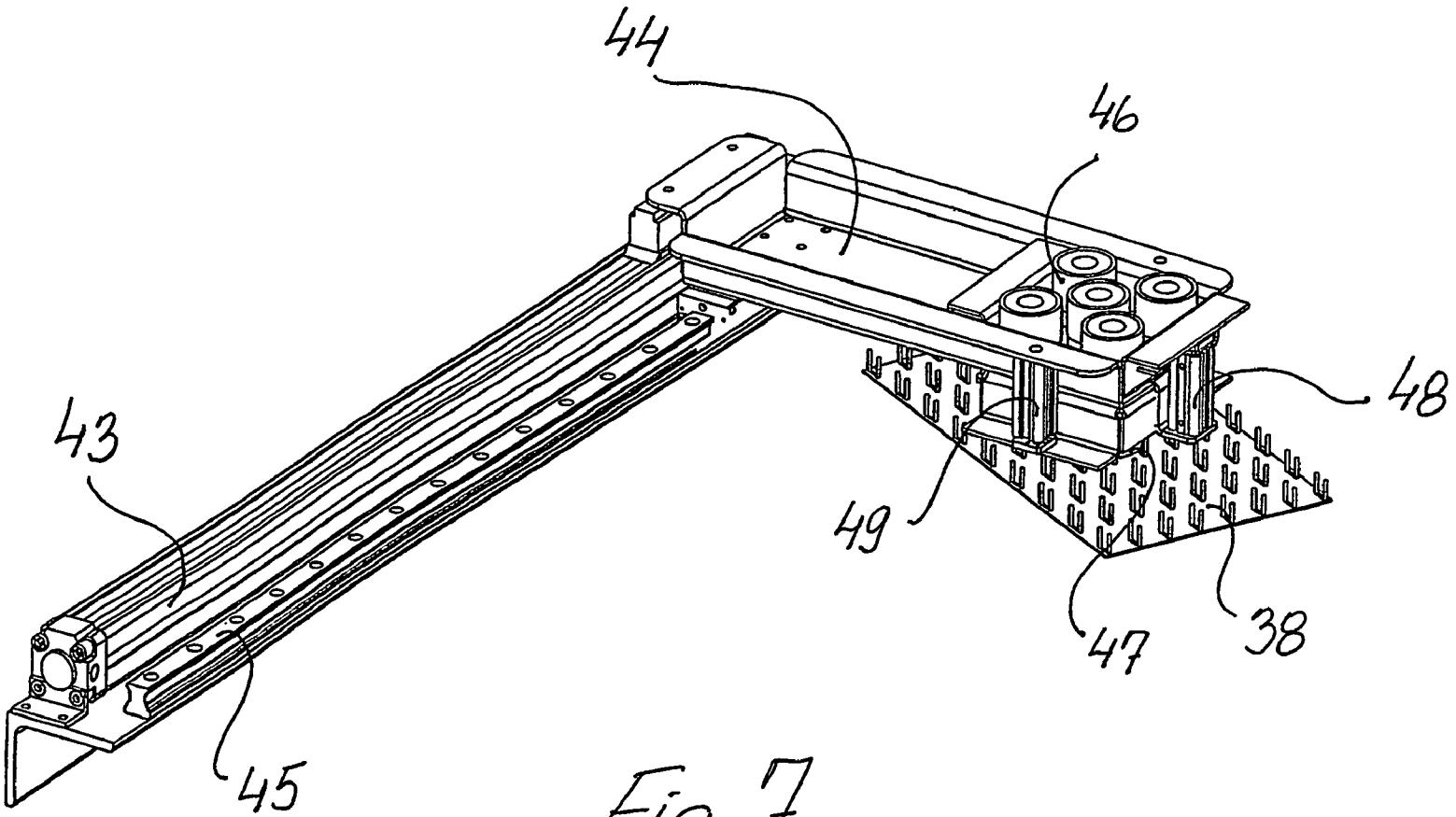
FIG. 7 is a perspective view of a part of the device illustrated in FIG. 6.

At the collection position at the end walls 26, 27, there are provided a number of nail plate magazines 36 which contain nail plates 38 disposed pairwise with the nail sides facing towards one another. By means of a piston and cylinder assembly, a loading plate 39 is switchable under each nail plate magazine 36 for projecting a nail plate pair 38 out from the magazine 36. As is apparent from FIG. 2, the nail plate magazines 36 are disposed beside one another so that a pair of collection- and orientation disks 37A and 37B are movable in front of the nail plate magazines 36 for receiving a nail plate pair 38. The collection- and orientation disks 37A and 37B are reciprocally movable in relation to one another and to a nail plate pair 38 placed between them by means of a piston and cylinder assembly 37C. It is also possible to have the one disk fixed in the vertical direction, but rotary, while the other is switchable by means of the piston and cylinder assembly 37C. The disks 37A and 37B are further rotary by means of a motor 37D via an upper toothed belt and a lower toothed belt as well as drive means and an interconnecting shaft 37F which is driven by means of the motor. The nail plate pair 38 is grasped by means of grippers 40 displaceable on the disks 37A and 37B towards the nail plate pair 38. The grippers 40 on the upper disk 37A are disposed to grasp the upper nail plate in the pair of nail plates 38, while the grippers 40 on the other disk 37B are disposed to grasp the upper nail plate in the pair of nail plates 38. This is facilitated in that the front edge of the grippers 40 is slanted and does not affect more than one of the nail plates in the pair of nail plates 38. The grippers 40 are reciprocal in relation to one another and the nail plate pair 38 by means of devices disposed on the underside of the disk 37B. Similar devices are mounted on the upper side of the disk 37A. On separation of the collection- and orientation disks 37A and 37B from one another, the nail plate pair 38 is separated. After the separation of the nail plate pair 38, the collection- and orientation disks 37A and 37B may be pivoted or rotated to the desired position. FIG. 5 illustrates that the collection- and orientation disks 37A and 37B are mounted on a carriage 41 which is displaceable in front of the magazine 36 to an end position at the end walls 26, 27. At the end position according to FIG. 6, the press tool with the press plates 30 and 31 is in the collection position, in which transfer devices 42, which are illustrated in greater detail in FIG. 3, are disposed to collect the nail plates 38 from the collection- and orientation disks 37A and 37B and move them to the press tool disks 30 and 31 where they are grasped by the magnets 35. The magnets 35 may be permanent magnets.

The transfer devices 42 comprise a piston and cylinder assembly 43 for switching of an arm 44 which is displaceable on a rail 45 and which supports a number of electromagnets 46 on its upper side and a number of electromagnets 47 on its under side, which support a nail plate 38 with the nail plate facing towards the magnets 47. The magnets 46 also support a nail plate 38 (not shown in FIG. 3) with the nail side facing towards the magnets 46. When the arm 44 is located between the press tool disks 30 and 31, the magnets 46 and 47 with the nail plates are moved apart from one another by means of pistons 48 and 49 for placing the nail plates on the permanent magnets 35 when the electromagnets 46 and 47 release the nail plates 38. The press tool disks 30 and 31 move the nail plates 38 to the desired joint and press them fast in position over the joint in the roof truss.

It is naturally possible to drive the device according to the present invention in an extremely rational manner by adjustment or positioning of the different parts being carried out with the aid of one or more computers and suitable software which permits the ordering of a roof truss. The collection- and orientation disks 37A and 37B are caused to collect the nail plates 38 in that sequence which is required for the selected roof truss. The collected nail plates 38 are transferred to the press tool carriages 28 and 29 for placing across and fixedly pressing over selected joints in the roof truss. This is repeated until all joints have been provided with nail plates.

Many modifications are naturally possible without departing from the scope of the inventive concept as this is defined in the appended Claims.

The invention claimed is:

1. A device for connecting a framework of lengths of timber, the timber comprising a plurality of upper frame sections, a plurality of lower frame sections, and a plurality of diagonals, the device comprising:

at least one press tool disposed to fixedly press at least one nail plate over joints between the lengths of timber;

a portal comprising a plurality of upper beams and a plurality of lower beams, the at least one press tool being disposed in the portal on the upper beams and the lower beams, wherein the at least one press tool is adjustable reciprocally across the framework between a collection position in which the at least one press tool collects a pair of nail plates, and a position over a joint for fixedly pressing one of the nail plates on an upper side and another on an under side of the joint, wherein a plurality of magazines with nail plates are disposed at the collection position, wherein orientation devices are provided at the collection position for receiving the pair of nail plates from the magazine and orienting the nail plates to a position in which they are to be fixedly pressed over the joint by the press tool, and wherein the orientation devices are configured to collect the pair of nail plates from the magazine and to orient the nail plates and separate the nail plates from one another before transferring to the at least one press tool; and a transfer device configured to transfer both of the pair of nail plates, at a same time, in an oriented position to the at least one press tool.

2. The device as claimed in claim 1, wherein the at least one press tool comprises:

an upper press plate;

an upper carriage;

a lower press plate; and a lower carriage, wherein the upper press plate and the lower press plate have a plurality of magnets for fixedly holding the nail plates from the collection position to the position for fixedly pressing the upper joint.

3. The device as claimed in claim 1, wherein a plurality of magazines with nail plates are disposed at the collection position for transferring nail plates of dimensions adapted to the joint to the orientation devices.

4. The device as claimed in claim 1, wherein a collection position is provided at each end of the portal and the nail plate magazines and the orientation devices are disposed at each collection position.

5. The device as claimed in claim 1, wherein the orientation devices are reciprocally movable in relation to one another and to the nail plates by a piston and cylinder assembly.

6. The device as claimed in claim 1, wherein the orientation devices comprise disks having grippers configured to grasp the nail plates.

7. The device as claimed in claim 6, wherein the grippers comprise a slanted front edge.

8. The device as claimed in claim 6, wherein the grippers are reciprocal in relation to one another and the nail plates.

9. The device as claimed in claim 1, wherein the orientation devices are mounted on a carriage, the carriage being displaceable, in front of the magazine, to an end position of the device.

10. The device as claimed in claim 1, wherein said plurality of nail plates are disposed side-by-side at the collection position.

11. The device as claimed in claim 1, wherein the orientation devices are disposed between the portal and the plurality of magazines.

12. The device as claimed in claim 1, wherein the orientation devices are adjustable reciprocally along the plurality of nail plates.

* * * * *